US006812389B2

(12) United States Patent
Trooien

(10) Patent No.: US 6,812,389 B2
(45) Date of Patent: Nov. 2, 2004

(54) LOCKING DEVICE FOR A TREMOLO

(76) Inventor: Aaron Rhett Trooien, 3634 Oxford Ct., Woodbury, MN (US) 55125

( * ) Notice: Subject to any disclaimer, the term of this patent is extended or adjusted under 35 U.S.C. 154(b) by 59 days.

(21) Appl. No.: 10/368,783

(22) Filed: Feb. 19, 2003

(65) Prior Publication Data

US 2004/0159206 A1 Aug. 19, 2004

(51) Int. Cl.[7] ..... G10D 3/00
(52) U.S. Cl. ..... 84/313; 84/312 R
(58) Field of Search ..... 84/313, 312 R

(56) References Cited

U.S. PATENT DOCUMENTS

| | | | | |
|---|---|---|---|---|
| 3,248,991 | A | 5/1966 | Cole | 84/313 |
| 3,326,072 | A | 6/1967 | Price | 84/313 |
| 4,137,812 | A | 2/1979 | Franzmann | 84/313 |
| 4,171,661 | A | 10/1979 | Rose | 84/313 |
| 4,317,403 | A | 3/1982 | Franzmann | 84/313 |
| 4,475,432 | A | 10/1984 | Stroh | 84/314 |
| 4,497,236 | A | 2/1985 | Rose | 84/298 |
| 4,549,461 | A | 10/1985 | Rose | 84/313 |
| 4,555,970 | A | 12/1985 | Rose | 84/313 |
| 4,632,005 | A | 12/1986 | Steinberger | 84/313 |
| 4,638,711 | A | 1/1987 | Stroh | 84/313 |
| 4,643,070 | A | 2/1987 | Petrillo | 84/313 |
| 4,674,389 | A | 6/1987 | Fender | 84/313 |
| 4,688,461 | A | 8/1987 | Stroh | 84/298 |
| 4,697,493 | A | 10/1987 | Ralston | 84/313 |
| 4,724,737 | A | 2/1988 | Fender | 84/313 |
| 4,763,555 | A | 8/1988 | Minakuchi et al. | 84/313 |
| 4,852,448 | A | 8/1989 | Hennessey | 84/313 |
| 4,882,967 | A | 11/1989 | Rose | 84/313 |
| 4,892,025 | A | 1/1990 | Steinberger | 84/313 |
| 4,967,631 | A | 11/1990 | Rose | 84/313 |
| D324,693 | S | 3/1992 | Rose | D17/21 |
| 5,140,884 | A | 8/1992 | Bowden | 84/312 R |
| 5,311,804 | A | 5/1994 | Wilkinson | 84/313 |
| 5,392,680 | A * | 2/1995 | Stets | 84/313 |
| 5,413,019 | A | 5/1995 | Blanda, Jr. | 84/298 |
| 5,431,079 | A | 7/1995 | Bunker | 84/313 |
| 5,438,902 | A | 8/1995 | Baker | 84/312 |
| 5,460,072 | A | 10/1995 | Ferdon | 84/313 |
| 5,515,761 | A | 5/1996 | Sides | 84/313 |
| 5,522,298 | A | 6/1996 | Schaller et al. | 84/313 |
| 5,522,299 | A | 6/1996 | Rose | 84/314 |
| 5,637,818 | A | 6/1997 | Fishman et al. | 84/313 |
| 5,986,192 | A | 11/1999 | Wingfield et al. | 84/313 |
| D420,694 | S | 2/2000 | Rose | D17/14 |
| 6,040,511 | A | 3/2000 | Hall | 84/313 |
| 6,046,393 | A | 4/2000 | Rose | 84/293 |
| 6,111,176 | A | 8/2000 | Rose | 84/297 |
| 6,130,373 | A | 10/2000 | Hall | 84/312 R |
| 2001/0002570 | A1 | 6/2001 | McCabe | 84/312 R |

FOREIGN PATENT DOCUMENTS

| | | |
|---|---|---|
| CA | 2016878 | 11/1991 |
| CA | 1295464 | 2/1992 |
| JP | 56-75793 | 6/1991 |

OTHER PUBLICATIONS

Product Line, The Point Classic Tremolo, Features of new tremolo vibrato bridge for electric guitars, Nov. 21, 2002, http://pointremolo.com/line.htm.

* cited by examiner

*Primary Examiner*—Shih-Yung Hsieh
(74) *Attorney, Agent, or Firm*—Kinney & Lange, P.A.

(57) ABSTRACT

A locking device for an electric guitar with a tremolo base plate prevents pivotal movement of the tremolo base plate. The locking device has a slide plate with a receptive slot for slidable reception of a cooperative key. The key contains a body for initiation of longitudinal motion within the slide plate slot and has an adjustable engagement member which is alignable for contact with a rear edge of the tremolo base plate.

15 Claims, 2 Drawing Sheets

LOCKING DEVICE FOR A TREMOLO

BACKGROUND OF THE INVENTION

The present invention relates generally to electric guitars. In particular, the present invention relates to a locking system for a floating bridge on an electric guitar.

Electric guitars usually include a body, a neck, and a head, with strings extending from tuning posts connected to the head down to a bridge which is attached to the body of the guitar. Electric guitars are often made or retrofitted with mechanisms for changing the tension on one or more of the strings so as to vary the pitch. One mechanism used for varying the pitch is often referred to as a tremolo, or a floating bridge. The use of such a mechanism changes the tension on all of the strings together, resulting in a vibrato or tremolo effect. This is a result of reducing the tension or increasing the tension on the strings in what is known as a "choking" effect, or "note bending" and/or "detuning".

Because of varying tensions on the strings caused by the use of the tremolo, the strings may slip with respect to the tuning posts, with the result being that one or more of the strings will go out of tune. To prevent the strings from going out of tune, an electric guitar with a floating bridge may incorporate a string locking device between the neck and the head. The string lock mechanism is a clamp used to clamp the strings in a fixed position after the guitar has been tuned. Tuning knobs are initially adjusted on the head to tune the guitar, and then the string lock is secured and the guitar may be played and the vibrato used without causing the strings to go out of tune. As a result of engaging the string lock, the tuning knob for each string is made become unavailable for use to adjust the pitch of its respective strings.

Ordinary use during the course of playing may cause strings to go out of tune due to various factors. As a result of this, many guitars include a method for tuning the guitar while the string lock is engaged. Such mechanisms are fine tuning mechanisms usually located on the bridge of the guitar, and serve to keep the guitar in tune unless a string breaks. A broken string may require the re-tuning of all the strings, since the tension on the other strings will change when the load born by a tremolo bridge's counter springs is compensated by the remaining strings (which is one less string than before the break). Replacing the broken string requires removal of the string locking device and re-tuning the instrument. Such an operation is time consuming. One way to reduce the amount of the time needed for re-tuning is to incorporate a bridge lock on the instrument to hold the bridge in place while replacing a broken string.

When a musician plays a guitar with a tremolo, a song often contains sections that do and do not require the use of the tremolo. Absent a locking mechanism, the tremolo is always active on the guitar when playing such a song. Players must be careful when playing an instrument with the tremolo engaged as any pressure on the bridge of the guitar will result in the strings being tensioned or loosened, resulting in a change in the pitch for those strings.

One solution to this problem is to employ a system whereby the player can somehow lock the floating tremolo bridge from movement relative to the guitar body. Locking the tremolo bridge prevents accidental motion of the tremolo bridge and provides a steadier tone when the strings are plucked, since there is no movement of the tremolo bridge. While tremolo locking systems are known, none provide a non-unintrusive, simple to mount and simple to manipulate locking system. Known locking systems may employ pivotal or rotation engagement of a locking device, which can be awkward for a musician to manipulate while simultaneously playing the guitar. In addition, many known locking systems may require more extensive modification of the guitar body than desired, and a resultant rather complicated installation procedure.

BRIEF SUMMARY OF THE INVENTION

In one embodiment, the present invention is a locking device for selectively preventing pivotal movement of a tremolo base plate toward and away from a guitar body. The tremolo base plate is of the type that is disposed under one end of a plurality of longitudinally extending guitar strings and has a laterally extending rear edge. The locking device comprises a slide plate attached to the guitar body adjacent the rear edge of the tremolo base plate, and a lock support slideably mounted on the slide plate. The lock support is moveable longitudinally on the slide plate between a first position spaced from the rear edge of the tremolo base plate and a second position engaged with the rear edge of the tremolo base plate. When the lock support is in its second position, the tremolo base plate is prevented from pivotal movement toward and away from the guitar body.

In one embodiment, the present invention is an improvement in a guitar of the type having a tremolo base plate mounted to a guitar body of the guitar for pivotal movement toward and away from the guitar body in order to produce tremolo sounds and a locking device for selectively preventing such pivotal movement. The improvement comprises a locking device having a lower portion and an upper portion, with the lower portion being fixedly attached relative to a top surface of the guitar body rearwardly from the tremolo base plate, and the upper portion being mounted on the lower portion for slideable longitudinal movement relative to the lower portion between a first disengaged position spaced from the tremolo base plate and a second engaged position contacting the tremolo base plate.

In one embodiment, the present invention is a method for selectively immobilizing a tremolo base plate from pivotal movement toward or away from a stringed instrument. The inventive method comprises: providing a slide plate affixed to the body of a stringed instrument, with a lock support slidably mounted on the slide plate, wherein the lock support has a tremolo plate engagement member moveably mounted thereon; selecting a locked position of the engagement member relative to the lock support; fixing the engagement member in the locked position; and longitudinally sliding the lock support along the slide plate until the engaging member contacts the tremolo base plate to fix it in position relative to the body of the stringed instrument.

BRIEF DESCRIPTION OF THE DRAWINGS

The present invention will be further explained with reference to the drawing figures listed below, wherein like structures are referred to by like numerals throughout the several views.

While the above-identified drawing figures set forth one embodiment of the invention, other embodiments are also contemplated, as noted in the discussion. In all cases, this disclosure presents the invention by way of representation and not limitation. It should be understood that numerous other modifications and embodiments can be devised by those skilled in the art which fall within the spirit and scope of the principles of this invention.

DETAILED DESCRIPTION

Figure 1:
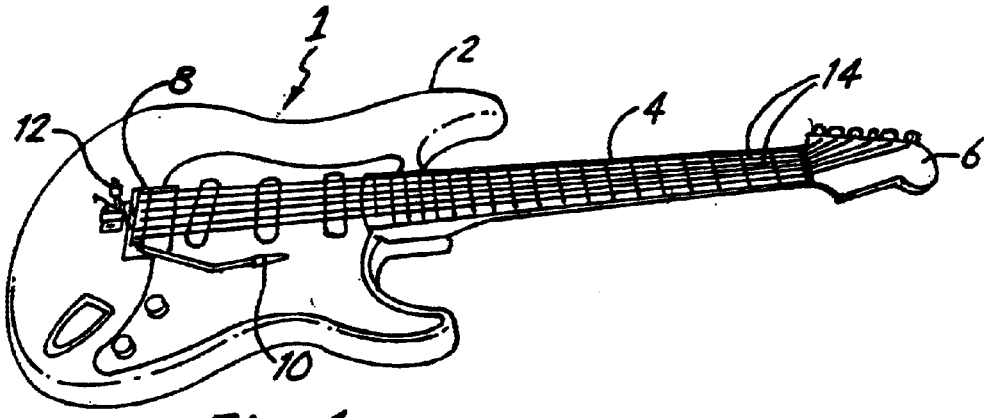
FIG. 1 is a isometric view of a guitar with a locking device mounted onto the guitar body, adjacent its tremolo bridge.

FIG. 1 illustrates a typical electric guitar of the type having a body 2, a neck 4, a head 6, a floating tremolo bridge 8 and a tremolo lever 10. The head 6, neck 4, and body 2 are usually made of wood or some composite or polymer, while the tremolo bridge 8 and tremolo lever 10 are usually constructed of metal such as steel. A plurality of longitudinally extending strings 14 are stretched from the head 6 of the guitar 1 over the length of a neck 4 and attached to the tremolo bridge 8. To create a tremolo sound effect, a player exerts pressure on the tremolo lever 10, which moves the tremolo bridge 8 relative to the guitar body 2. The movement of the tremolo bridge 8 changes the tension exerted on the strings 14, resulting in a change in pitch when the strings 14 are played. Rapid back and forth or rocking movement of the tremolo lever 10 will produce a vibrato effect. The FIGS. illustrate a six string guitar, but this is only intended to represent a typical stringed instrument for application of the present invention, which will have applicability on any stringed instrument having a floating tremolo bridge.

As seen in FIG. 1, a tremolo locking device 12 is mounted on the guitar body 2, adjacent the tremolo bridge 8. When activated, the locking device 12 stops all motion of the tremolo bridge 8 by holding the bridge in a stable position relative to the guitar body 2. The lack of motion of the tremolo bridge 8 has two advantages. First, if one of the strings breaks, the rest of the strings are stabilized in position and may not require immediate re-turning. As a result, play of the guitar may continue (even absent one of the strings) and when that string is eventually replaced, the tuning operation is quicker, allowing a player to reduce downtime of the instrument. Second, the tremolo bridge 8 is held in a fixed position so there is no motion in the tremolo bridge 8, and thus none in the strings 14. This creates a steady tone as the strings 14 are played.

Figure 3:
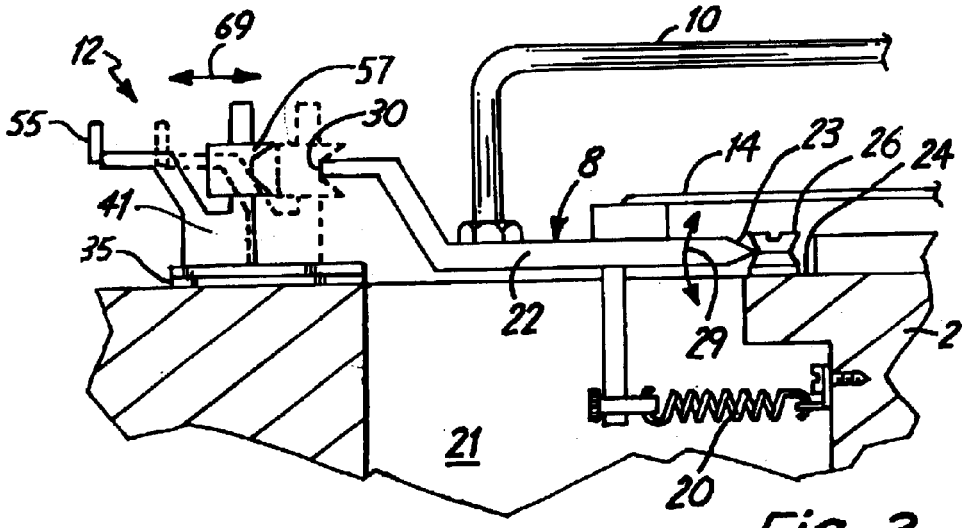
FIG. 3 is a sectional view as taken along lines 3—3 in FIG. 2.
Figure 2:
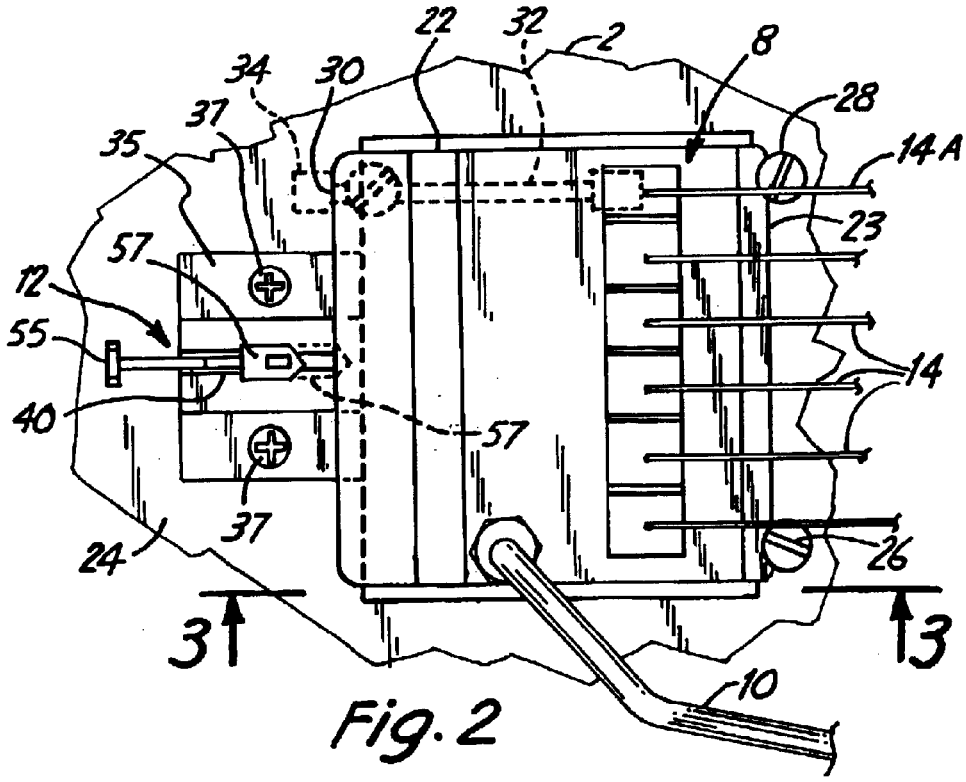
FIG. 2 is an enlarged top view of the tremolo bridge and the locking device.

FIGS. 2 and 3 are enlarged views of the tremolo bridge 8 and inventive locking device 12. As illustrated in FIG. 3, the tension provided by a spring 20 under the tremolo bridge 8 exerts a force against the tension exerted by the strings 14 on the top of the tremolo bridge 8. The spring 20 is attached to the guitar body 2 in a cavity 21 below the tremolo bridge 8. In this exemplary form of a tremolo bridge 8, the tremolo bridge 8 has a tremolo base plate 22 extending over the cavity 21. The tremolo base plate 22 is pivotally connected at its front end 23 to a top surface 24 of the guitar body 2, adjacent a forward end of the cavity 21. A pair of pivot mounts 26 and 28 are fastened to the guitar body 2 and positioned against the front end 23 of the tremolo base plate 22. The pivot mounts 26 and 28 are notched or tapered to provide lateral pivoting points for the front end 23 of the tremolo base plate 22, which itself is tapered to a laterally extending sharp front edge in engagement with the pivoting points of the pivot mounts 26 and 28. Unless the inventive locking device 12 is engaged, the tremolo base plate 22 is thus free to pivot relative to the guitar body 2 about the pivoting points 26 and 28, in direction of arrows 29 (FIG. 3). In operation, the player moves the tremolo lever 10 attached to the tremolo base plate 22. The resulting movement of the tremolo base plate 22 changes the pitch of the strings 14 by extending or shortening the length of the strings 14 as the player pushes down or pulls up on the tremolo lever 10 (relative to the guitar body 2).

As illustrated by FIG. 3, the tremolo base plate 22 is held in a steady position if there is no pressure put onto the tremolo lever 10 due to the force exerted on the tremolo bridge 8 by the spring 20. However, since the tremolo base plate 22 contains six strings 14 attached to it, if one string should break, the string tension counteracting the tension of the spring 20 changes and the tremolo base plate 22 will move (pivoting downwardly, or counterclockwise as viewed in FIG. 3). For this reason (among others), the locking device 12 is installed to provide a means for holding the tremolo base plate 22 steady when the guitar player so desires.

The tremolo bridge 8 illustrated in FIGS. 1–3 is shown in simplified form for clarity. The tremolo base plate 22 has a laterally extending rear edge 30 thereon, as seen in FIGS. 2 and 3. It is typical for a tremolo bridge 8 to include a fine tuning adjustment apparatus for each string 14. An exemplary fine tuning apparatus 32 is illustrated in phantom for string 14A in FIG. 2, and may include an adjustment knob 34 for each string 14 extending rearwardly past the rear edge 30 of the tremolo base plate 22. The fine tuning adjustment apparatus 32 is used to fine tune a string independently of other strings, without using a string tuning knob on the head 6 of the guitar 1.

Figure 4:
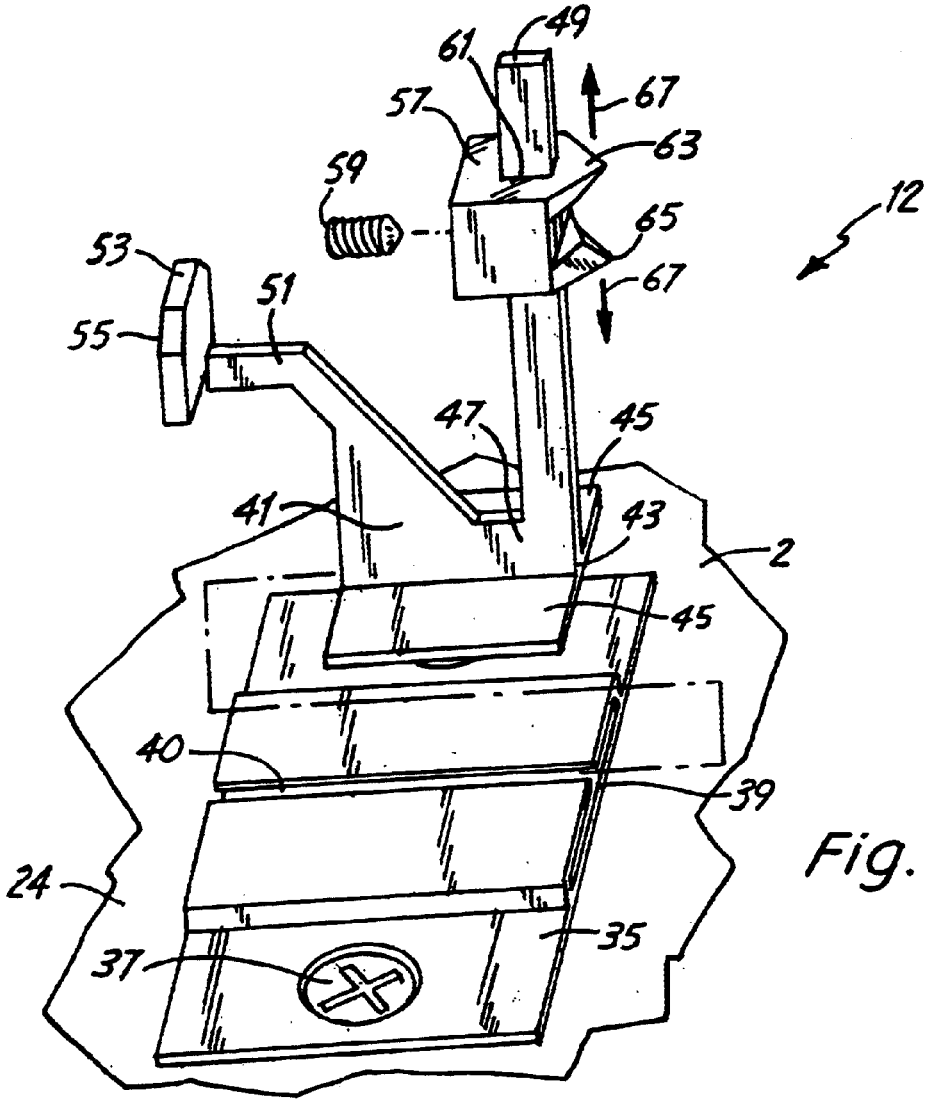
FIG. 4 is an exploded view showing the components of the inventive locking device.

The inventive locking device 12 is mounted onto the guitar body 2 adjacent the rear edge 30 of the tremolo base plate 22. The locking device includes a slide plate 35 which is attached to the top surface 24 of the guitar body 2 using one or more screws 37 or similar fasteners. In the illustrated embodiment, two screws 37 are used to secure the slide plate 35. The holes for the screws 37 in the slide plate 35 are countersunk to allow tapered screw heads to lie flush or below the surface of the slide plate 35. The slide plate 35 is mounted near the rear edge 30 of the tremolo base plate 22 (just rearwardly of the cavity 21 in the guitar body 2). The slide plate 35 has a longitudinally extending keyway 39 thereon, as seen in FIG. 4, which defines a slide slot 40. In the illustrated embodiment, the keyway 39 is shaped like an inverted "T", but any suitable keyway shape will suffice. The locking device 12 includes a lock support 41 which has a key 43 (FIG. 4) shaped to mate with the shape of the keyway 39 in the slide plate 35. This cooperative arrangement thus permits longitudinal movement of the lock support 41 relative to the slide plate 35 (and tremolo bridge 8).

In the embodiment illustrated, the key 43 of the lock support 41 is shaped like an inverted "T" formed by horizontal wings 45, 45 and a vertical body 47. A vertical upper member 49 extends from the vertical body 47 adjacent a forward end of the body 47. From a rear end of the lock support 41, a handle 51 extends rearwardly beyond the vertical body 47 and has a plate 53 attached thereto. The plate 53 is chamfered on its top corners to eliminate sharp corners that could injure a performer utilizing the locking device 12. In the embodiment illustrated, the handle 51 angles vertically toward the rear, and then extends horizontally and rearwardly, perpendicular to the vertical upper member 49. The plate 53 and handle 51 form a finger touch arm 55 for use in manual manipulation of the locking device 12 while playing the guitar 1. While performing, the player may manually push or pull the finger touch arm 55, thus moving the lock support 41 longitudinally relative to the slide plate 35 and tremolo bridge 8.

An engagement member 57 is movably mounted on the vertical upper member 49 of the lock support 41. The engagement member 57 contains a threaded hole on a rear side thereof for reception of a set screw 59. A vertical bore 61 extends through the engagement member 57 and is shaped to slidably receive the vertical upper member 49 of the lock support 41. In the illustrated embodiment, the engagement member 57 is parallelopiped shaped. Two jaws 63 and 65 extend from the top and bottom of a front side of the engagement member 57. The jaws 63 and 65 are mirrors of each other, and contain angled faces extending from outer surfaces toward inner surfaces. A portion of the front side of the engagement member 57, between inner faces of the jaws 63 and 65, extends laterally and is shaped for reception of the rear edge 30 of the tremolo base plate 22. Thus, the front side of the engagement member 57 contains a c-shaped opening to allow for reception of the rear edge 30 of the tremolo base plate 22. By using the set screw 59, the engagement member 57 can be fixed in position anywhere along the height of the vertical upper member 49 of the lock support 41, as indicated by arrows 67. This allows the player to adjust the locking device 12 to fix the position of the tremolo bridge 8 in any position he or she desires relative to the guitar body 2. The components of the locking device 12 are made of metal or some other suitably rigid material (i.e., polycarbonate).

FIGS. 2 and 3 show the locking device 12 in two positions, relative to the tremolo bridge 8: (1) spaced rearwardly and disengaged (in solid), and (2) moved forwardly and engaged (in phantom). The keyway and key are shaped so that the lock support 41 does not separate from the slide plate 35 at either end thereof. The lock support 41 is retained in its desired position relative to the slide plate 35 by friction, yet the lock support 41 is easily movable longitudinally by manual pressure on the touch arm 55 thereof (in direction of arrows 69 in FIG. 3) to either engage or disengage the engagement member 57 and the rear edge 30 of the tremolo base plate 22. When the tremolo bridge 8 includes fine tuning adjustment apparatus (which may include adjustment knobs 34 (FIG. 2) extending rearwardly from the tremolo base plate 22, the engagement member 57 is shaped and positioned to engage the tremolo base plate 22 without interfering with the fine tuning adjustment apparatus (or other devices mounted on the guitar 1). Preferably, the slide plate 35 is positioned so that when the locking device 12 is engaged, the engagement member 57 contacts the center of the rear edge 30 of the tremolo base plate 22. However, it is possible to mount the locking device 12 elsewhere as long as the engagement member 57 is contacting the rear edge 30 of the tremolo bridge plate 22.

Since the engagement member 57 is adjustable, it is possible for a player to use the locking device 12 to aid in the tuning of the guitar 1. This is accomplished by setting the set screw 59 in the engagement member 57 in a higher or lower position along the vertical upper member 49 of the lock support 41. For example, by setting the engagement member 57 at the top end of the vertical upper member 49, and locking the tremolo base plate 22 at this position, the tremolo bridge 8 will be pivoted upward, thus reducing the length and tension of the strings 14 and resulting in a flattened tone of all the strings 14. To engage the tremolo base plate 22 in this position the player must exert some upward pressure on the tremolo arm 10 to draw the tremolo base plate 22 upwardly. The lock support 41 is then moved forwardly so that the engagement member 57 thereon engages the rear edge 30 of the tremolo base plate 22.

The locking device of the present invention, when engaged, stops motion of the tremolo bridge in both pivotal directions. Also, the present invention provides an easy to manipulate tool to assist in re-tuning a guitar when a string breaks by only requiring the tuning of a single string instead of all strings on the instrument. The invention overcomes the drawbacks present in prior art, and is a simple, inexpensive and easily accessible addition to an existing instrument. The present invention is easy to use while playing the instrument requiring, for example, only a single finger to selectively disable the tremolo bridge and create a fixed bridge.

Although the present invention has been described with reference to preferred embodiments, workers skilled in the art will recognize that changes may be made in form and detail without departing from the spirit and scope of the invention. For instance, as noted above, the slot in the slide plate created by the keyway can be of numerous geometries so long as it allows for the reception and longitudinal sliding of a lock support key therein. As discussed above, friction alone may suffice to retain the lock support in a desired position relative to the slide plate, although other means for doing so can be provided, such as detent engagement therebetween or the use of one or more magnets operable to hold the lock support in place relative to the slide plate. Shapes for the lock support 41 and its components (e.g., the touch arm 55 and engagement member 57) other than those illustrated are contemplated, so long as the requisite functions are achieved.

What is claimed is:

1. A locking device for selectively preventing pivotal movement of a tremolo base plate toward and away from a guitar body, wherein the tremolo base plate is of the type that is disposed under one end of a plurality of longitudinally extending guitar strings and has a laterally extending rear edge, the locking device comprising:

a slide plate attached to the guitar body adjacent the rear edge of the tremolo base plate; and a lock support slidably mounted on the slide plate and movable longitudinally thereon between a first position spaced from the rear edge of the tremolo base plate and a second position engaged with the rear edge of the tremolo base plate, wherein the tremolo base plate is prevented from pivotal movement toward and away from the guitar body when the lock support is in its second position.

2. The locking device of claim 1 wherein the slide plate is affixed to a top surface of the guitar body.

3. The locking device of claim 1 wherein the lock support includes means for varying the elevation of the base plate relative to the guitar body when the lock support is in its second position.

4. The locking device of claim 3 wherein the means for varying the elevation of the base plate relative to the guitar body comprises:

an engagement member adapted for engagement with the rear edge of the tremolo base plate;

means for varying the height of the engagement member relative to the slide plate; and means for securing the engagement member at a selected height relative to the slide plate.

5. The locking device of claim 1 wherein the slide plate has a longitudinally extending slot and the lock support has a cooperatively shaped key which is slidable within the slot.

6. The locking device of claim 1 wherein the lock support includes a handle thereon to facilitate manual movement thereof between its first and second positions.

7. The locking device of claim 4 wherein the engagement member is c-shaped.

8. The locking device of claim 4 wherein the means for securing the engagement member comprises a set screw.

9. In a guitar of the type having a tremolo base plate mounted to a guitar body of the guitar for pivotal movement toward and away from the guitar body in order to produce tremolo sounds and a locking device for selectively preventing such pivotal movement, the improvement which comprises:

the locking device having a lower portion and an upper portion, the lower portion being fixedly attached relative to a top surface of the guitar body rearwardly from the tremolo base plate and the upper portion being mounted on the lower portion for slidable longitudinal movement relative to the lower portion between a first disengaged position spaced from the tremolo base plate and a second engaged position contacting the tremolo base plate.

10. The locking device of claim 9 wherein the lower portion has a longitudinally extending slot and the upper portion has a cooperatively shaped key which is sizable within the slot.

11. The locking device of claim 10 wherein the upper portion has a first end adjacent the tremolo base plate and a second end longitudinally spaced from the first end, and wherein the upper portion comprises:

a tremolo base plate engagement member adjacent the first end of the upper portion; and a finger touch arm adjacent the second end of the upper portion.

12. The locking device of claim 11 wherein the upper portion includes means for varying the elevation of the engagement member relative to the guitar body when the locking device is in its second position.

13. The locking device of claim 12 wherein the engagement member comprises:

an upright member on the upper portion; and a c-shaped plate slidably mounted on the upright member.

14. The locking device of claim 13 wherein the position of the c-shaped plate relative to the upright member is determined by manipulation of a set screw on the c-shaped plate.

15. A method for selectively immobilizing a tremolo base plate from pivotal movement toward or away from a stringed instrument, comprising:

providing a slide plate affixed to the body of a stringed instrument, with a lock support slidably mounted on the slide plate, wherein the lock support has a tremolo plate engagement member movably mounted thereon;

selecting a lock position of the engagement member relative to the lock support;

fixing the engagement member in the lock position; and longitudinally sliding the lock support along the slide plate until the engaging member contacts the tremolo base plate to fix it in position relative to the body of the stringed instrument.

* * * * *